US005384039A

United States Patent [19]

Padron et al.

[11] Patent Number: 5,384,039

[45] Date of Patent: Jan. 24, 1995

[54] CRUDE OIL DEHYDRATION AND DESALTING SYSTEM WITH A HIGHER GRAVITY THAN 10 DEGREES API IN MIXING PIPELINES

[75] Inventors: Aaron Padron, Caracas; Ender Anez; Raul Possamai, both of Ciudad Ojeda, all of Venezuela

[73] Assignee: Maravan, S.A., Caracas, Venezuela

[21] Appl. No.: 922,727

[22] Filed: Jul. 31, 1992

[51] Int. Cl.[6] ..... C10G 33/04

[52] U.S. Cl. ..... 208/187; 208/188

[58] Field of Search ..... 208/187, 188

[56] References Cited

U.S. PATENT DOCUMENTS

| | | | |
|---|---|---|---|
| 4,188,277 | 2/1980 | Martin | 204/190 |
| 4,505,839 | 3/1985 | Bellos et al. | 252/344 |
| 4,551,239 | 11/1985 | Merchant et al. | 208/187 |
| 4,806,231 | 2/1989 | Chirinos et al. | 208/262.1 |
| 4,956,653 | 6/1986 | Graham et al. | 208/188 |

*Primary Examiner*—Paul Lieberman
*Assistant Examiner*—Patricia L. Hailey
*Attorney, Agent, or Firm*—Bachman & LaPointe

[57] ABSTRACT

A method for dehydrating and desalting an oil-in-water emulsion includes the steps of: injecting a demulsifier into the flow to destabilize the emulsion; injecting water to promote desalting; and passing the flow through a mixing pipeline having a length (L) and inside diameter (D) determined as follows:

$$D^7 = \frac{6.3 \times 10^{-4} f \cdot \rho_e \cdot Q_e^3}{\mu_e \cdot K \cdot F^2}$$

$$L = \frac{t \cdot Q_e}{76.45 \cdot D^2}$$

wherein:

f—is a Fanning Friction factor $\rho_e$—is a density of the emulsion (gm/cc);

$Q_e$—is a flow rate of the emulsion (bbl/day);

$\mu_e$—is a viscosity of the emulsion (poise);

K—is an instrument constant of a dynamic coalescer;

F—is a rotational speed of the dynamic coalescer (rpm);

t—is a mixing time (hr);

D—is the inside diameter of mixing pipeline (inches); and

L—is the length of the mixing pipeline (km).

11 Claims, 3 Drawing Sheets

CRUDE OIL DEHYDRATION AND DESALTING SYSTEM WITH A HIGHER GRAVITY THAN 10 DEGREES API IN MIXING PIPELINES

BACKGROUND OF THE INVENTION

The invention relates to the field of treatment of oil-in-water emulsions, and, more particularly, to a process for dehydrating and desairing heavy crude oil utilizing a demulsifier, water, and a mixing pipeline.

Dehydration of crude oil-in-water emulsions is typically carried out in washing tanks of various configuration, wherein the emulsified oil is introduction into the tank and passed through a water cushion wherein a washing process takes place due to the physical-chemical similarity of the phases. Separation is completed by gravity.

A laboratory technique has been developed by F. H. Meijs wherein fluctuating doses of surfactant are added along with a fixed amount of mixing energy during a desired period of time in order to facilitate separatation of oil and water.

U.S. Pat. No. 4,806,231 to Chirinos et al discloses a Method For Desalting Crude Oil wherein salt content of crude oil is reduced by washing crude oil containing residual salt water with washing water and allowing the resulting mixture to settle. Chirinos forms an emulsion to transfer salt from crude oil into the added water, and then teaches that the emulsion must be broken in a conventional manner, such as settling or through electrostatic means. Thus, breaking the end product emulsion of Chirinos et al. is still a time consuming or complicated procedure.

The time required for completion of such separation processes is clearly important as a longer treatment time will require additional tanks and treatment facilities in order to treat a particular flow.

It is therefore desirable to obtain a treatment procedure for such oil-in-water emulsions which takes less time.

Accordingly, it is the principal object of the present invention to provide a process whereby crude-in-water emulsions can be treated in less time than is required in conventional processes.

It is a further object of the present invention to provide a process for treatment of oil-in-water emulsions which requires a lesser amount of surfactant and other additives such as fresh water which may be scarce at the point of use.

Other objects and advantages will become apparent to those skilled in the art after a consideration of the following disclosure of the invention.

SUMMARY OF THE INVENTION

The foregoing objects, and others, are obtained in a process for dehydrating and desalting a flow of oil-in-water emulsion, comprising the steps of:

injecting a demulsifier into the flow to destabilize the emulsion;

injecting water to promote desalting; and passing the flow through a mixing pipeline having a length (L) and diameter (D) selected, based on fluid characteristics of the emulsion, so as to substantially dehydrate and desalt the emulsion. The length (L) and diameter (D) are preferably determined according to the following equations:

$$D^7 = \frac{6.3 \times 10^{-4} f \cdot \rho_e \cdot Q_e^3}{\mu_e \cdot K \cdot F^2}$$

$$L = \frac{t \cdot Q_e}{76.45 \cdot D^2}$$

wherein:

f—is the Fanning Friction factor:

$\rho_e$—is the density of the emulsion (gm/cc);

$Q_e$—is the flow rate of the emulsion (bbl/day);

$\mu_e$—is the viscosity of the emulsion (poise);

K—is an instrument constant of the dynamic coalescer;

F—is the rotational speed of the dynamic coalescer (rpm);

t—is the mixing time (hr);

D—is the inside diameter of the mixing pipeline (inches); and

L—is the pipe length (km).

The demulsifier is preferably added in an amount of 10–100 ppm.

Water is added in an amount preferably in the range of 15–25% by volume.

Oil-in-water emulsions treated according to the aforesaid procedure can be separated in the mixing pipeline to the extent where the crude oil enters a separator tank having a content of emulsified water of less than 4%, the remaining water having been freed from the emulsion for conventional separation.

BRIEF DESCRIPTION OF THE DRAWINGS

A detailed description of the invention follows, with reference to the accompanying drawings, wherein.

DETAILED DESCRIPTION OF THE INVENTION

Figure 1:
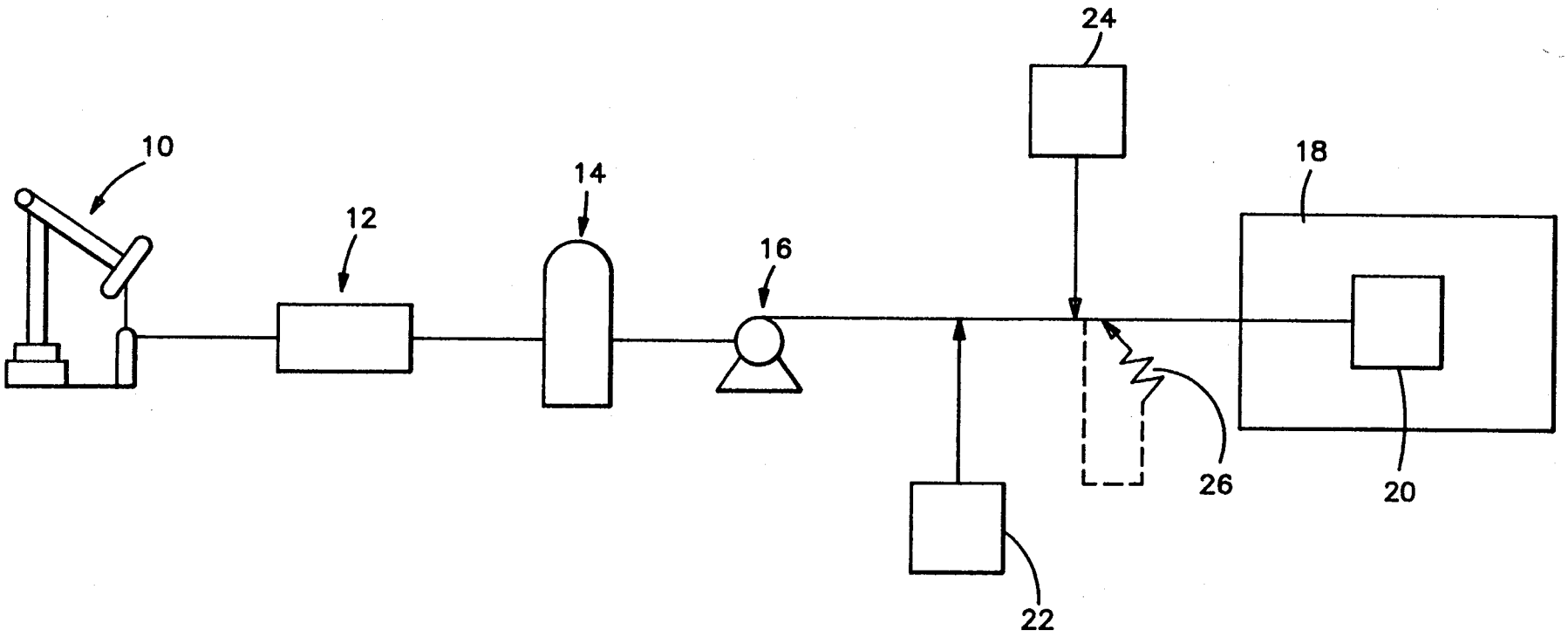
FIG. 1 is a schematic representation of a system for treating oil-in-water emulsions.

Referring to the drawings, a detailed description of the preferred embodiments of the invention will be given.

FIG. 1 is a schematic illustration of a system for treating oil-in-water emulsions. According to the invention, oil-in-water emulsion flows preferably having a gravity of higher than 10° API and a water content by volume of 10–30% can be treated to break the emulsion and separate substantial amounts of the water. The crude may also be purged of substantial amounts of salt, if present.

The oil-in-water emulsion to be treated is produced from a well 10 and passed to a flow station 12. From flow station 12, the emulsion flows to a degasifier 14, and then to surface pumps 16. From surface pumps 16, the emulsion is transported to a main station 18. Prior to entering a gun barrel 20 of main station 18, the emulsion is treated with a demulsifier 22 in the range of 10–100 ppm, most preferably 50 ppm, and subsequently with washing water 24, preferably fresh water, in an amount of 15–25% by volume, most preferably 20%. After the addition of demulsifier 22 and water 24, the emulsion is passed through a mixing pipeline 26 to provide a mixing energy or turbulence which causes water droplets contained in the emulsion to coalesce, thus substantially breaking the emulsion. The mixing pipeline 26 preferably has a diameter (D) and length (L) which are determined according to the following equations:

$$D^7 = \frac{6.3 \times 10^{-4} f \cdot \rho_e \cdot Q_e^3}{\mu_e \cdot K \cdot F^2}$$

$$L = \frac{t \cdot Q_e}{76.45 \cdot D^2}$$

wherein:

f—is the Fanning Friction factor;

$\rho_e$—is the density of the emulsion (gm/cc);

$Q_e$—is the flow rate of the emulsion (bbl/day);

$\mu_e$—is the viscosity of the emulsion (poise);

K—is an instrument constant of a dynamic coalescer;

F—is the rotational speed of the dynamic coalescer (rpm);

t—is the mixing time (hr);

D—is the internal pipe diameter (inches); and

L—is the pipe length (km).

While any demulsifier could be used, an example of a suitable demulsifier is DISOLVAN D. 2820A, produced by Hoechst Company.

Washing water is preferably added to the emulsion at or near its point of entry into the mixing pipeline. This allows simultaneous desalting and coalescence of the emulsion.

A convenient source of washing water may be water separated from the emulsion being treated. This separated water may preferably be used provided that the salt content thereof is not prohibitively high.

The disclosed method was tested under laboratory conditions.

During the testing, a crude oil-in-water emulsion was used having a gravity of 11.0 API and having a 30% water content. The washing water used was water separated from previous treatments of the same emulsions.

The laboratory tests were carried out using a "dynamic coalescer", supplied by Shell, which is used for simulating the mixture intensity conditions as well as oil temperature at field level. This device is designed for use in the selection of dehydrating chemicals, and yields results which are highly reproducible at field level. The rotational speed F and constant K of the coalescer may be needed, depending upon the coalescer used, to correct the measurements obtained by the instrument to accurate field conditions. These qualities will, of course, differ depending upon the machine used to obtain the estimation of field conditions.

Figure 2:
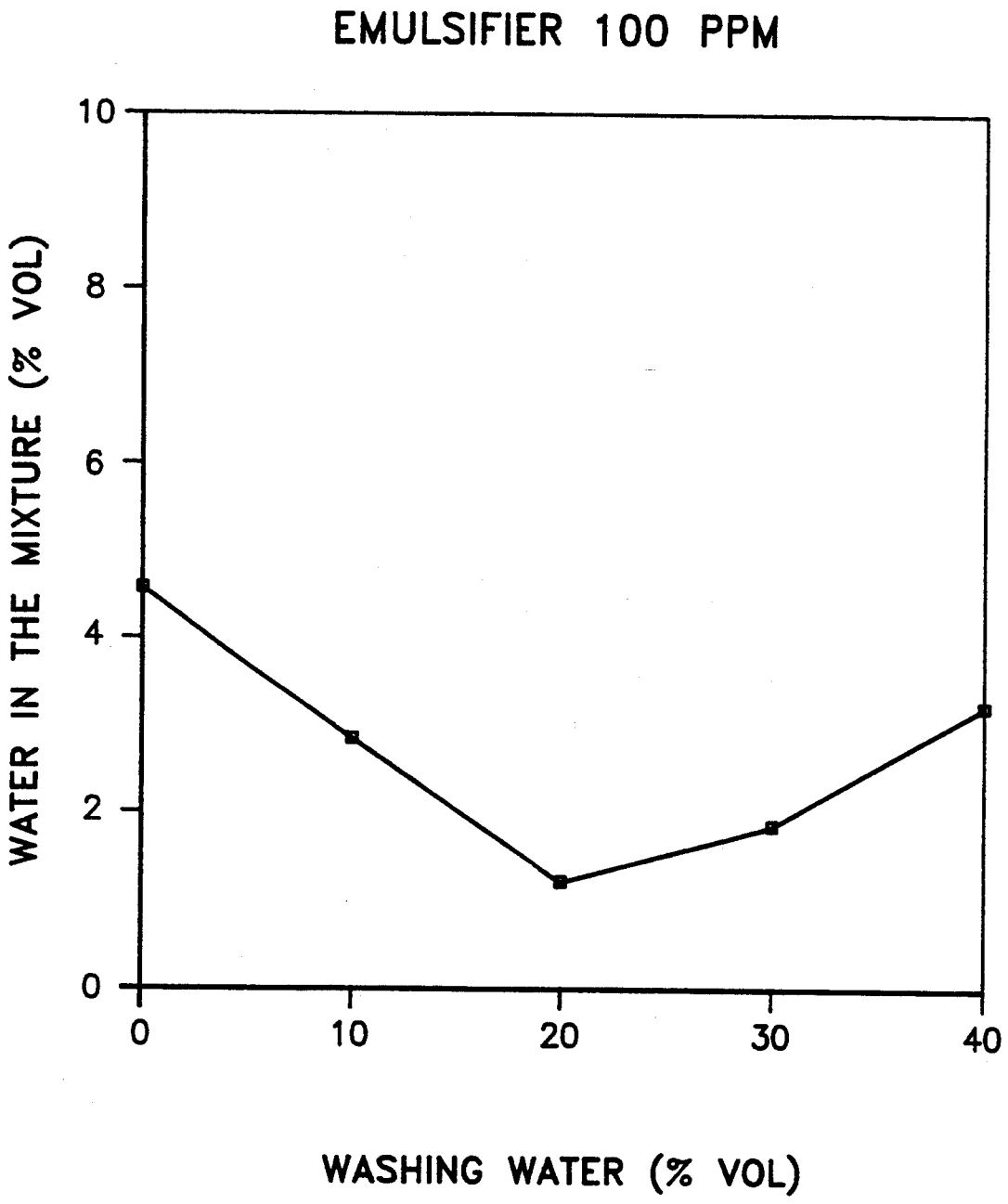
FIG. 2 is a graphic representation of the relationship between the percentage of added water to the percentage of water remaining in the mixture, when 100 ppm of a demulsifier is added.

Laboratory tests were carried out using emulsifier in the amount of 100 ppm, and varying the amount of washing water used. The results of this test are summarized in FIG. 2. The amount of water retained in the emulsion so tested reached a minimum below 2% at 20% washing water. Thus, it appears that with the addition of 100 ppm of demulsifier, optimum results are obtained at about 20% (by volume) washing water.

Figure 3:
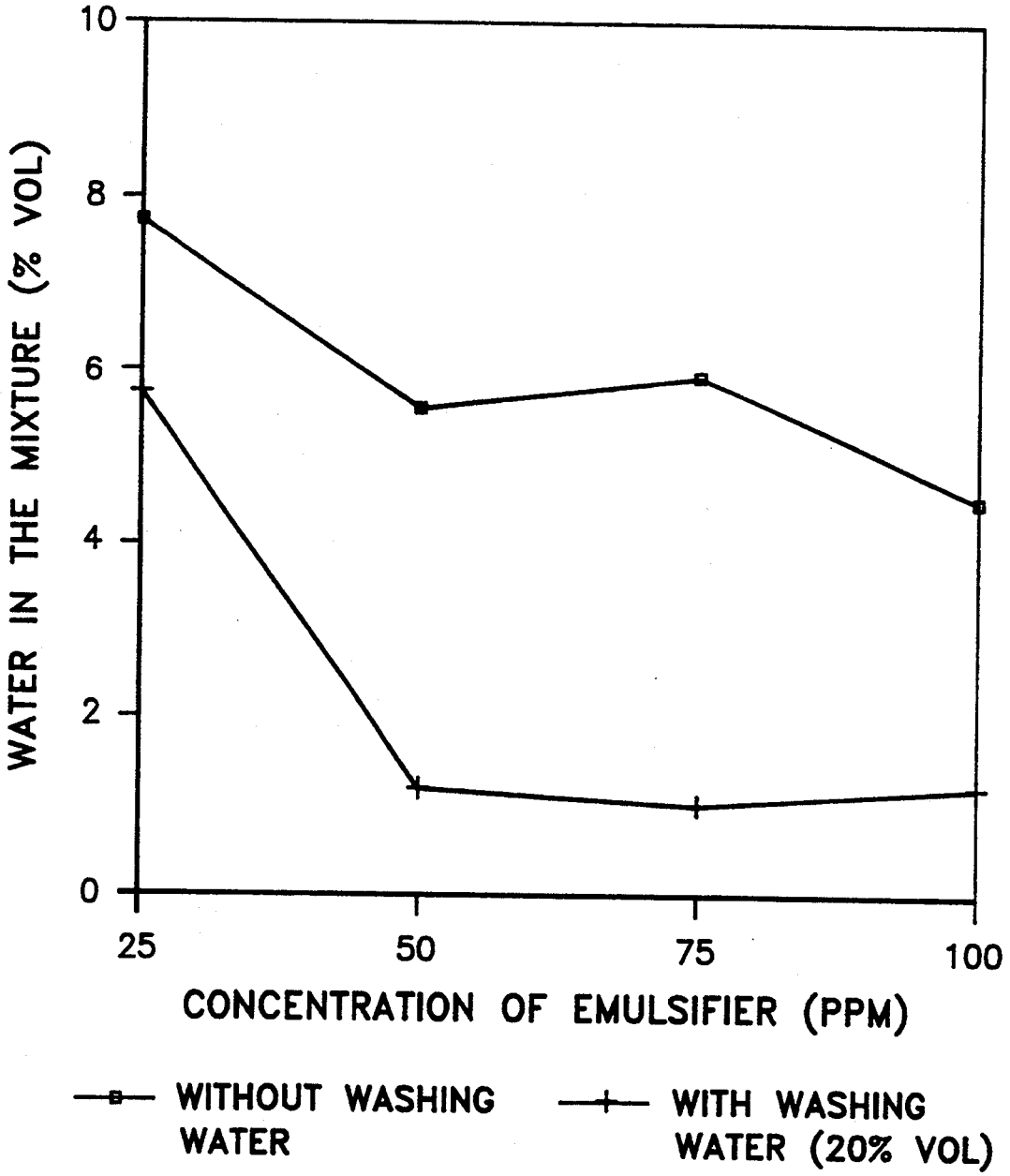
FIG. 3 is a graphic representation of the relation between the concentration of the demulsifier and the water remaining in the mixture.

Next, tests were conducted using various concentrations of demulsifier for treatments including 0% washing water and treatments containing 20% washing water. As shown in FIG. 3, the results of these tests show that the concentration of demulsifier can be reduced to 50 ppm when 20% washing water is being used, without significant deterioration of results.

Tests were also conducted in order to determine the necessity of using the demulsifier surfactant to break up the emulsion prior to addition of washing water. Tests were conducted using no demulsifier and varying amounts of washing water. The results of this test are summarized below in Table I.

TABLE I

| WASHING WATER (% vol) | WATER IN EMULSION (% vol) |
|---|---|
| 0 | 32 |
| 10 | 39 |
| 20 | 38 |
| 30 | 38 |
| 30 | 26 |

The amount of water in the emulsion actually increased when washing water was added without demulsifier. Thus, when no demulsifier is used, a portion of the washing water is added to the emulsion. Thus, the demulsifier is clearly necessary to obtain desirable results.

In order to confirm these laboratory experiments, facilities were constructed on a pilot scale. Tests were conducted in the pilot plant to determine the effect upon process time and remaining water percentage of altering the volume of washing water used. When no washing water was used, the process time increased dramatically. For example, it took approximately 24 hours to reach 5% water in the emulsion with no washing water. A 5% figure was reached with 20% washing water in approximately 10 hours. The process, when conducted without washing water, requires a significantly longer amount of time to obtain the same results as those obtained according to the present invention.

Thus disclosed is a process for dehydrating and desalting a crude oil-in-water emulsion, wherein mixing energy is supplied to the emulsion through a mixing pipeline to significantly decrease the required reaction time for effective breaking of the emulsion and removal of water.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A system for dehydrating and desalting a crude-oil-in-water emulsion, comprising:

a flowline carrying the emulsion providing an oil-water emulsion wherein the water content is about less than or equal to 30% by volume;

means for adding demulsifier to the emulsion;

means for adding washing water to the emulsion, whereby a mixture of emulsion, demulsifier and washing water is formed; and a mixing pipeline means for imparting mixing energy to the mixture, the mixing pipeline having a length (L) and diameter (D) selected, based on fluid characteristics of the emulsion, wherein said length (L) and said diameter (D) of said pipeline are determined according to the following equations:

$$D^7 = \frac{6.3 \times 10^{-4} f \cdot \rho_e \cdot Q_e}{\mu_e \cdot K \cdot F_2}$$

$$L = \frac{t \cdot Q_e}{76.45 \cdot D^2}$$

wherein:

f—is a Fanning Friction factor;

$\rho_e$—is a density of the emulsion (gm/cc);

$Q_e$—is a flow rate of the emulsion (bbl/day);

$\mu_e$—is a viscosity of the emulsion (poise);

K—is an instrument constant of a dynamic coalescer;

F—is a rotational speed of the dynamic coalescer (rpm);

t—is a mixing time (hr);

D—is the inside diameter of the mixing pipeline (inches); and

L—is the length of the mixing pipeline (km), so as to coalesce water droplets of the emulsion thereby desalting and substantially breaking the emulsion as the emulsion passes through said mixing pipeline, so as to obtain a water content about less than or equal to 5% by volume.

2. A system according to claim 1, wherein the means for adding washing water is located at or near a point in the flow line where the mixture enters the mixing pipeline, whereby the mixture is desalted by the washing water and water droplets are coalesced by the mixing pipeline substantially simultaneously.

3. A method for desalting and substantially breaking an oil-in-water emulsion, comprising providing an oil-in-water emulsion wherein the Water content is about less than or equal to 30% by volume, mixing the emulsion with a demulsifier and water to form an emulsion mixture, and passing the emulsion mixture through a mixing pipeline means of length (L) and diameter (D) sufficient to impart a mixing energy to the emulsion for desalting the emulsion and coalescing water droplets of the emulsion, wherein said length (L) and said diameter (D) of said pipeline are determined according to the following equations:

$$D^7 = \frac{6.3 \times 10^{-4} f \rho_e Q_e}{\mu_e K F_2}$$

$$L = \frac{t Q_e}{76.45 D^2}$$

wherein:

f—is a Fanning Friction factor;

$\rho_e$—is a density of the emulsion (gm/cc);

$Q_e$—is a flow rate of the emulsion (bbl/day);

$\mu_e$—is a viscosity of the emulsion (poise);

K—is an instrument constant of a dynamic coalescer;

F—is a rotational speed of the dynamic coalescer (rpm);

t—is a mixing time (hr);

D—is the inside diameter of the mixing pipeline (inches); and

L—is the length of the mixing pipeline (km), so as to substantially break the emulsion as the emulsion passes through said mixing pipeline, so as to obtain a water content about less than or equal to 5% by volume.

4. A method according to claim 3, wherein the demulsifier is injected in an amount of 10–100 ppm.

5. A method according to claim 3, wherein the demulsifier is injected in an amount of 50 ppm.

6. A method according to claim 3, wherein water is injected in a range of 15–25% by volume.

7. A method according to claim 3, wherein water is injected in an amount of 20% by volume.

8. A method according to claim 3, wherein water is mixed with the emulsion and the emulsion is passed through the mixing pipeline substantially simultaneously, whereby the emulsion is desalted and substantially broken substantially simultaneously.

9. A method according to claim 3, wherein the mixing pipeline means has a length (L) and an inside diameter (D) selected, based upon fluid characteristics of the emulsion, so as to impart said mixing energy and to coalesce said water droplets.

10. A method according to claim 3, further including the step of providing the oil-in-water emulsion having a water content of between 10 to 30% by volume.

11. A method according to claim 10, wherein the step of passing the emulsion through the mixing pipeline reduces the water content to less than 5% by volume.

* * * * *